US009004653B2

(12) United States Patent
Ikeuchi et al.

(10) Patent No.: US 9,004,653 B2
(45) Date of Patent: Apr. 14, 2015

(54) LIQUID EJECTING HEAD AND RECORDING DEVICE USING SAME

(75) Inventors: Wataru Ikeuchi, Kirishima (JP); Kenichi Yoshimura, Kirishima (JP); Naoki Kobayashi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/126,249

(22) PCT Filed: Mar. 30, 2012

(86) PCT No.: PCT/JP2012/058574
§ 371 (c)(1),
(2), (4) Date: Dec. 13, 2013

(87) PCT Pub. No.: WO2013/001878
PCT Pub. Date: Jan. 3, 2013

(65) Prior Publication Data

US 2014/0118445 A1 May 1, 2014

(30) Foreign Application Priority Data

Jun. 29, 2011 (JP) ..... 2011-144431
Nov. 28, 2011 (JP) ..... 2011-259097

(51) Int. Cl.
*B41J 2/045* (2006.01)
*B41J 2/14* (2006.01)
*B41J 2/155* (2006.01)
*B05B 17/00* (2006.01)

(52) U.S. Cl.
CPC ..... *B41J 2/14201* (2013.01); *B41J 2/155* (2013.01); *B41J 2002/14459* (2013.01); *B41J 2202/11* (2013.01); *B41J 2202/20* (2013.01); *B05B 17/0646* (2013.01)

(58) Field of Classification Search
None
See application file for complete search history.

(56) References Cited

U.S. PATENT DOCUMENTS

2002/0080215 A1 6/2002 Sakaida et al.
2005/0036008 A1 2/2005 Hirota et al.
2005/0200663 A1 9/2005 Hibi et al.
2006/0066677 A1 3/2006 Hori

FOREIGN PATENT DOCUMENTS

JP 2003305852 A 10/2003
JP 2005059397 A 3/2005
JP 2005238721 A 9/2005

(Continued)

OTHER PUBLICATIONS

International Search Report, PCT/JP2012/058574, May 2, 2012, 2 pp.

*Primary Examiner* — Lisa M Solomon
(74) *Attorney, Agent, or Firm* — Volpe and Koenig, P.C.

(57) ABSTRACT

A liquid ejecting head and a recording device are disclosed. The head includes a fluid channel member and a piezoelectric substrate on the fluid channel member. The fluid channel member includes chambers, each having a diamond shape with two obtuse angle portions and two acute angle portions. In a plan view, the chambers are arranged in a matrix, and aligned in directions of a row and of a column. The substrate includes a first electrode, a piezoelectric body and second electrodes. Each of the second electrodes includes a main electrode and a lead-out portion. The main electrode overlaps with the respective chamber, and is located inside the chamber in the plan view. The lead-out electrode includes: a first end which overlaps with the respective chamber; and a second end located outside the chamber and located in a region that does not overlap with the column in the plan view.

8 Claims, 9 Drawing Sheets

(56) References Cited

FOREIGN PATENT DOCUMENTS

| | | | | |
|---|---|---|---|---|
| JP | 2006102982 | A | | 4/2006 |
| JP | 2008044296 | A | | 2/2008 |
| JP | 2012096385 | A | * | 5/2012 |

* cited by examiner

LIQUID EJECTING HEAD AND RECORDING DEVICE USING SAME

FIELD OF INVENTION

The present invention relates to a liquid ejecting head configured to eject a liquid, and a recording device that uses this liquid ejecting head.

BACKGROUND

Printing devices using inkjet recording methodologies such as inkjet printers and inkjet plotters are not only used in consumer-grade printers but are also widely used in manufacturing applications such as the forming of electrical circuits, the manufacture of color filters for liquid crystal displays, and the manufacture of organic EL displays.

These kind of inkjet printing devices are provisioned with liquid ejecting heads configured to eject liquid as the printing head. The following are generally known as methodologies for these kinds of printing heads. One methodology is the thermal head type in which a heater functioning as a pressurizer is provisioned in an ink channel where the ink is filled. The ink is heated and boiled by the heater, then pressurized by air bubbles generated by the boiling of the ink in the ink channel, and ejected as droplets from the ink ejection hole. Another methodology is the piezoelectric type in which a portion of the walls of the ink channel where the ink is filled are made to flex by a displacing element, and this process mechanically pressurizes the ink in the ink channel to eject the ink as droplets from the ink ejection hole.

There are also the following methods in which these kinds of liquid ejecting heads are used to execute the recording. One is the serial method which executes the recording by moving the liquid ejecting head in a direction (primary scanning direction) orthogonal to the conveyance direction of the recording medium (secondary scanning direction). Another is the line method which executes the recording onto the recording medium conveyed in the secondary scanning direction, by a fixed liquid ejecting head which is elongated in the primary scanning direction. The line method has an advantage of being capable of producing high-speed recordings as the liquid ejecting head does not need to be moved as with the serial method.

A well-known configuration of the liquid ejecting head long in one direction includes a laminating of a fluid channel member including a manifold functioning as a shared channel and holes connected to the manifold via multiple compression chambers, and an actuator unit including multiple displacing elements provisioned to cover the compression chambers (refer to PTL 1 for example). The compression chambers connected to the multiple ejection holes are arranged in a matrix formation in this liquid ejecting head, and so ink is ejected from the ejection holes by causing displacing elements in the actuator unit configured to cover the compression chambers to displace, enabling printing in the primary scanning direction at a resolution of 600 dpi.

CITATION LIST

Patent Literature

PTL 1: Japanese Unexamined Patent Application Publication No. 2003-305852

SUMMARY

Technical Problem

However, there are cases in which sufficient printing precision may not be obtained due to great influence of crosstalk between the displacing elements when attempting to increase the resolution using a configuration of the liquid ejecting head similar to that in PTL 1.

Thus, the aim of the present invention is to provide a liquid ejecting head that minimizes crosstalk and a recording device using this liquid ejecting head.

The liquid ejecting head according to the present invention is provisioned with a fluid channel member including a plurality of ejection holes and a plurality of compression chambers connected to respective corresponding ejection holes, and a piezoelectric actuator substrate laminated on the fluid channel member so as to cover the plurality of compression chambers. The piezoelectric actuator substrate is laminated with a first electrode, a piezoelectric body, and a plurality of second electrodes in this order from the side of the fluid channel member. When the liquid ejecting head is viewed from the plan view, each of the plurality of compression chambers has a diamond shape comprising two obtuse angle portions and two acute angle portions, the plurality of compression chambers are arranged in substantially equal spacings in a direction of a row which runs along a diagonal connecting the two obtuse angle portions, and in a direction of a column which runs along a diagonal connecting the two acute angle portions, the plurality of the second electrode comprises: a main electrode arranged so as to overlap the plurality of compression chambers respectively. and contained inside the compression chamber, and a lead-out electrode one end of which is connected to the main electrode and the other end of which is led out to the external side of the compression chamber. The lead-out electrode passes through one of the acute angle portions of the compression chamber, and the other end is led out to a region that does not overlap with the column.

The recording device according to the present invention is provisioned with the liquid ejecting head, a conveying unit for conveying a recording medium toward the liquid ejecting head, and a control unit for controlling a piezoelectric actuator substrate.

Advantageous Effects of Invention

According to the present invention, the effect of crosstalk is minimized to enable an improvement in printing precision.

DETAILED DESCRIPTION OF THE PREFERRED EMBODIMENTS

Figure 1:
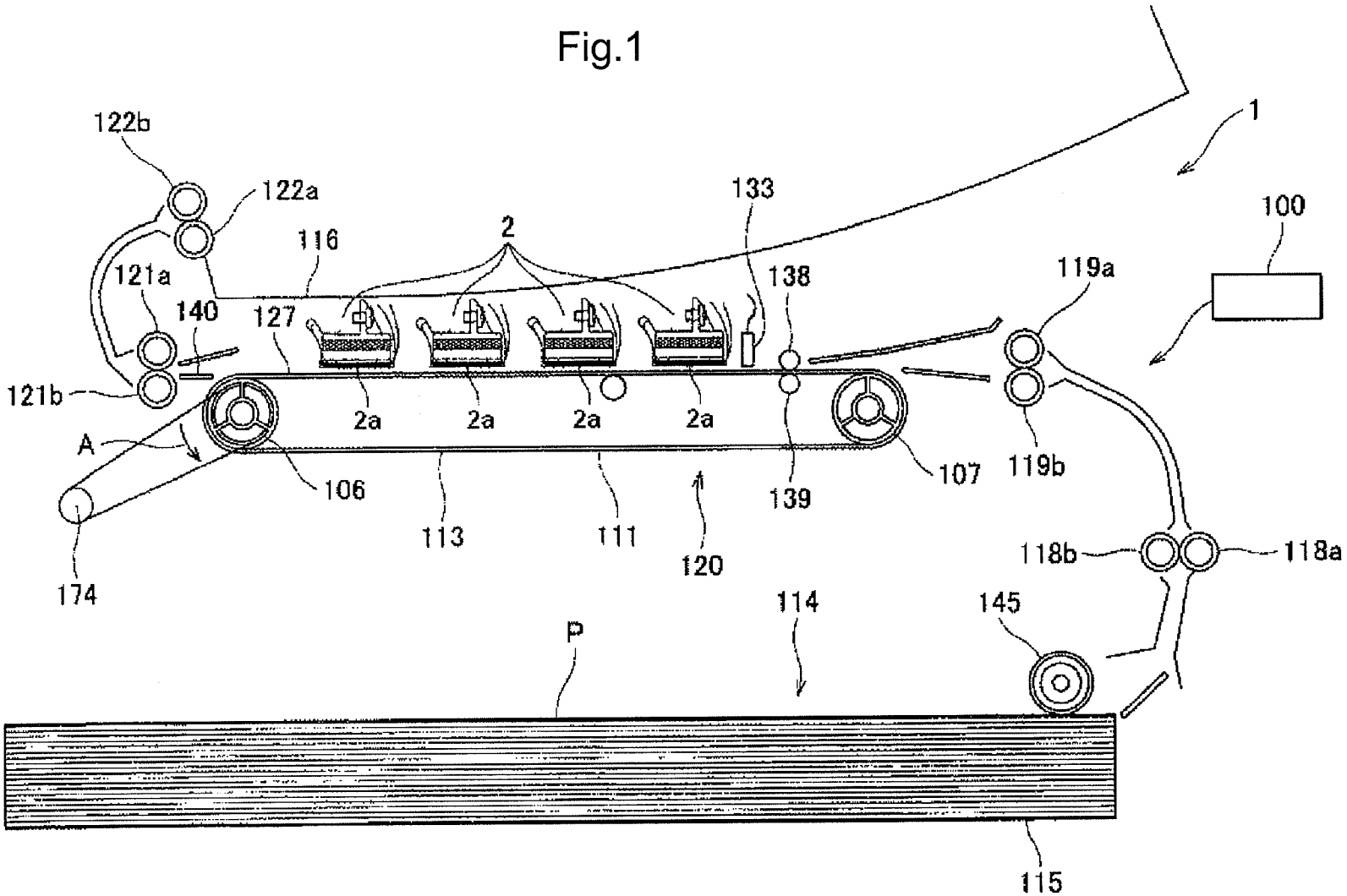
FIG. 1 is a diagram illustrating an overview configuration of a color inkjet printer functioning as a recording device which includes a liquid ejecting head according to an embodiment of the present invention.

FIG. 1 is a diagram illustrating a summary configuration of a color inkjet printer functioning as a recording device which includes a liquid ejecting head according to an embodiment of the present invention. This color inkjet printer 1 (hereafter, referred to as printer 1) includes four liquid ejecting heads 2. These liquid ejecting heads 2 are lined along the conveyance direction of a printing paper P, and are fixed to the printer 1. The liquid ejecting heads 2 have a long and narrow rectangular form in the direction from the near side toward the far side as in FIG. 1. This length direction may also be called the longitudinal direction.

The printer 1 is provisioned with a paper feed unit 114, a conveying unit 120, and a paper receiving unit 116 in this order along the conveyance path of the printing paper P. The printer 1 is also provisioned with a control unit 100 to control the operations of the various components of the printer 1 such as the liquid ejecting head 2 and the paper feed unit 114.

The paper feed unit 114 includes a paper storage case 115 capable of storing multiple sheets of the printing paper P, and a paper feed roller 145. The paper feed roller 145 feeds the top-most sheet of printing paper P one sheet at a time from the stack of the printing paper P stored in the paper storage case 115.

A pair of feed rollers 118*a* and 118*b* and a pair of feed rollers 119*a* and 119*b* are arranged between the paper feed unit 114 and the conveying unit 120 along the conveyance path of the printing paper P. The printing paper P conveyed from the paper feed unit 114 is guided by these feed rollers to the conveying unit 120.

The conveying unit 120 includes an endless conveying belt 111 and two belt rollers 106 and 107. The conveying belt 111 is looped around the belt rollers 106 and 107. The length of the conveying belt 111 is adjusted so that the belt retains a predetermined amount of tension when looped around the two belt rollers. As a result, the conveying belt 111 is tautened without having any slack along two parallel planes which are common tangents of the two belt rollers. The closer of these two planes to the liquid ejecting head 2 is a conveying plane 127 that conveys the printing paper P.

A conveying motor 174 is connected to the belt motor 106 as illustrated in FIG. 1. The conveying motor 174 rotates the belt motor 106 in the direction indicated by the arrow A. The belt roller 107 is rotated by the movement of the conveying belt 111. Therefore, the conveying belt 111 moves along the direction indicated by the arrow A by the drive force generated by the conveying motor 174 to rotate the belt motor 106.

A nip roller 138 and a nip receiving roller 139 are in an arrangement sandwiching the conveying belt 111 near the belt roller 107. The nip roller 138 is biased downwards by a spring not illustrated. The nip receiving roller 139, which is below the nip roller 138, accepts the nip roller 138 biased downwards via the conveying belt 111. The two nip rollers are provisioned to be rotatable, and so rotate by the movement of the conveying belt 111.

The printing paper P fed from the paper feed unit 114 to the conveying unit 120 is sandwiched between the nip roller 138 and the conveying belt 111. As a result, the printing paper P is pushed against the conveying plane 127 of the conveying belt 111 to be adhered on top of the conveying plane 127. The printing paper P is then conveyed by the rotation of the conveying belt 111 in the direction where the liquid ejecting head 2 is arranged. An outer surface 113 of the conveying belt 111 may also be processed with silicone rubber having adhesive properties. As a result, the printing paper P may be reliably anchored to the conveying plane 127.

The liquid ejecting head 2 includes a head body 2*a* on the lower end. The lower surface of the head body 2*a* forms an ejection hole surface 4-1 provisioned to multiple ejection holes for ejecting liquid.

Liquid (ink) of the same color is ejected from a liquid ejection hole 8 provisioned to one liquid ejecting head 2. The liquid is supplied from an external liquid tank, which is not illustrated, in the liquid ejecting head 2. The ejection hole 8 in each liquid ejecting head 2 opens to the ejection hole surface arranged at equal intervals along a singular direction (the longitudinal direction of the liquid ejecting head 2, which is the direction that is perpendicular to the conveyance direction of the printing paper P and parallel with the printing paper P). This enables printing without any gaps along the singular direction. The color of the liquid ejected from each liquid ejecting head 2 is, for example, magenta (M), yellow (Y), cyan (C), and black (K). Each liquid ejecting head 2 is arranged having a slight space between the lower surface of a liquid ejecting head body 13 and the conveying plane 127 of the conveying belt 111.

The printing paper P which is conveyed by the conveying belt 111 moves in the space between the liquid ejecting head 2 and the conveying belt 111. During this process, droplets are ejected onto the top surface of the printing paper P from the head body 2*a* configuring the liquid ejecting head 2. As a result, a color image based on image data stored by the control unit 100 is formed onto the top surface of the printing paper P.

A separating plate 140, a pair of feed rollers 121*a* and 121*b*, and a pair of feed rollers 122*a* and 122*b* are arranged between the conveying unit 120 and the paper receiving unit 116. The printing paper P to which the color image is printed is conveyed to the separating plate 140 by the conveying belt 111. The printing paper P is separated from the conveying plane 127 at this point by the right edge of the separating plate 140. Then, the printing paper P is conveyed to the paper receiving unit 116 by the feed rollers 121*a* through 122*b*. In this way, the printed printing paper P is conveyed sequentially to and stacked in the paper receiving unit 116.

A paper surface sensor 133 is arranged between the nip roller 138 and the liquid ejecting head 2 which is the furthest upstream in the conveyance direction of the printing paper P. The paper surface sensor 133 is configured with light-emitting elements and photoreceptor elements to detect the leading edge of the printing paper P on the conveyance path. The detection result from the paper surface sensor 133 is sent to the control unit 100. The control unit 100 may control the liquid ejecting head 2 and the conveying motor 174 so that the conveyance of the printing paper P synchronizes with the image to be printed on the basis of the detection result sent from the paper surface sensor 133.

Figure 2:
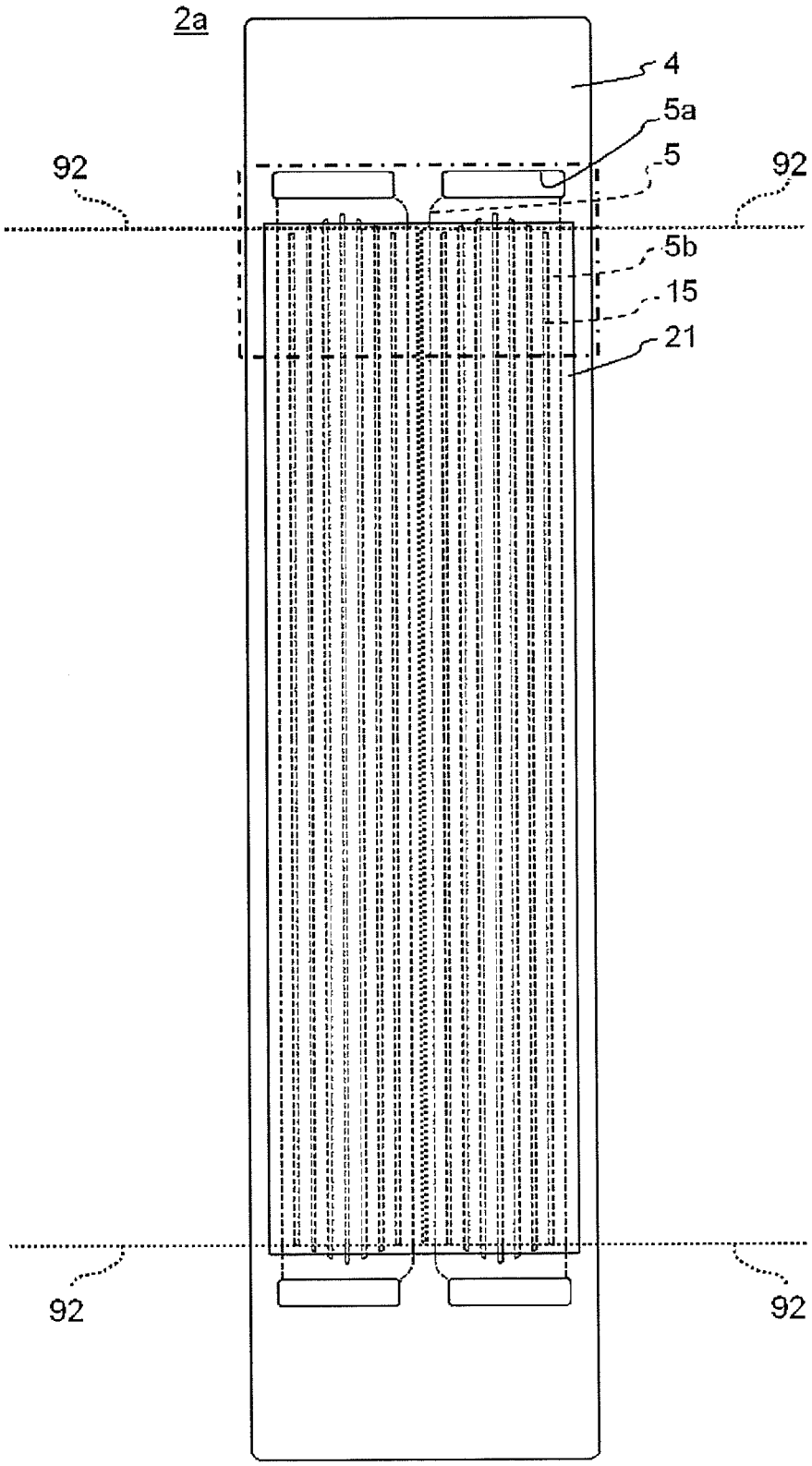
FIG. 2 is a plan view of a fluid channel member and a piezoelectric actuator configuring the liquid ejecting head in FIG. 1.
Figure 3:
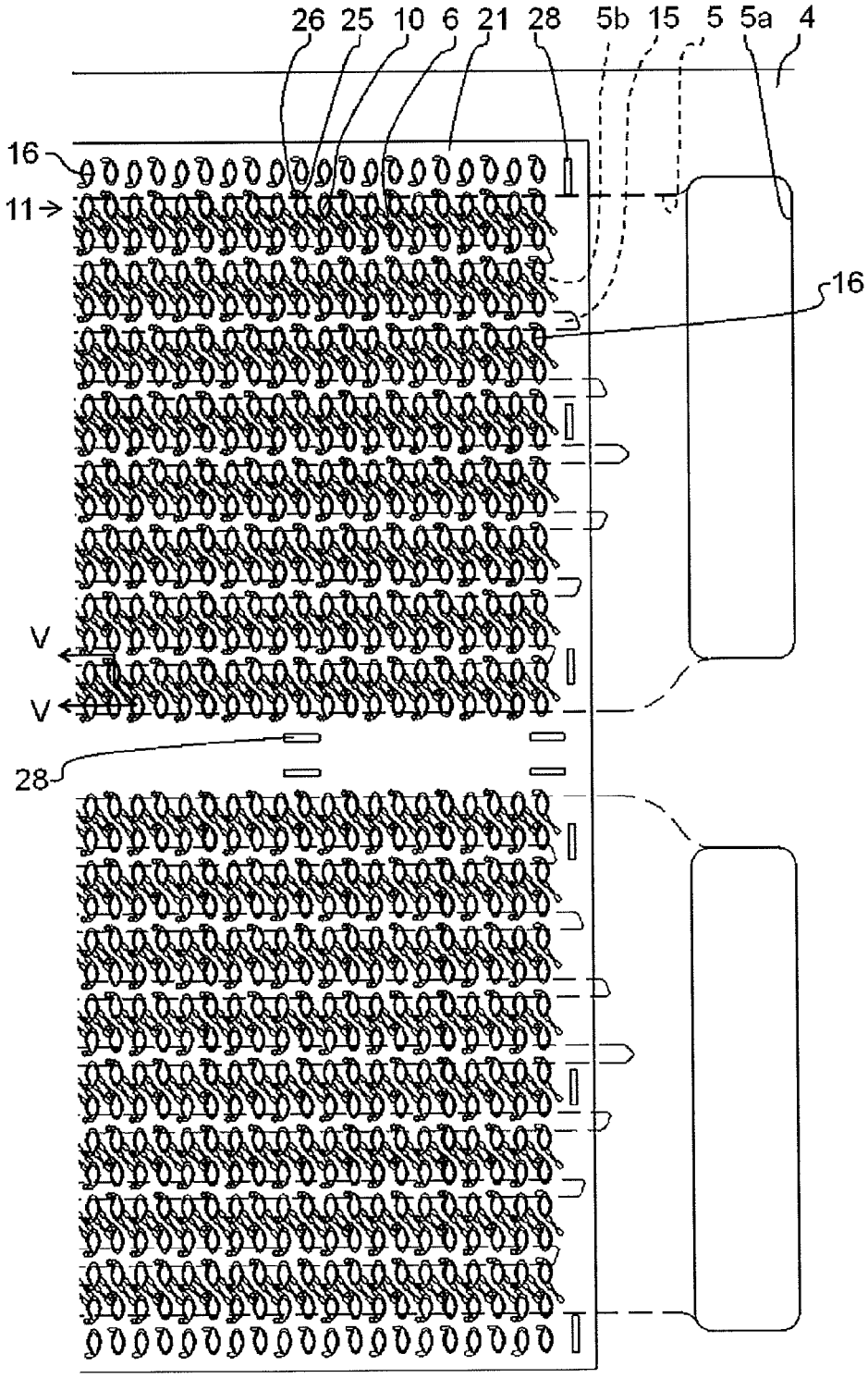
FIG. 3 is an enlarged view of the region in FIG. 2 enclosed in a dotted line, in which a portion of the channel is omitted to simplify the description.
Figure 4:
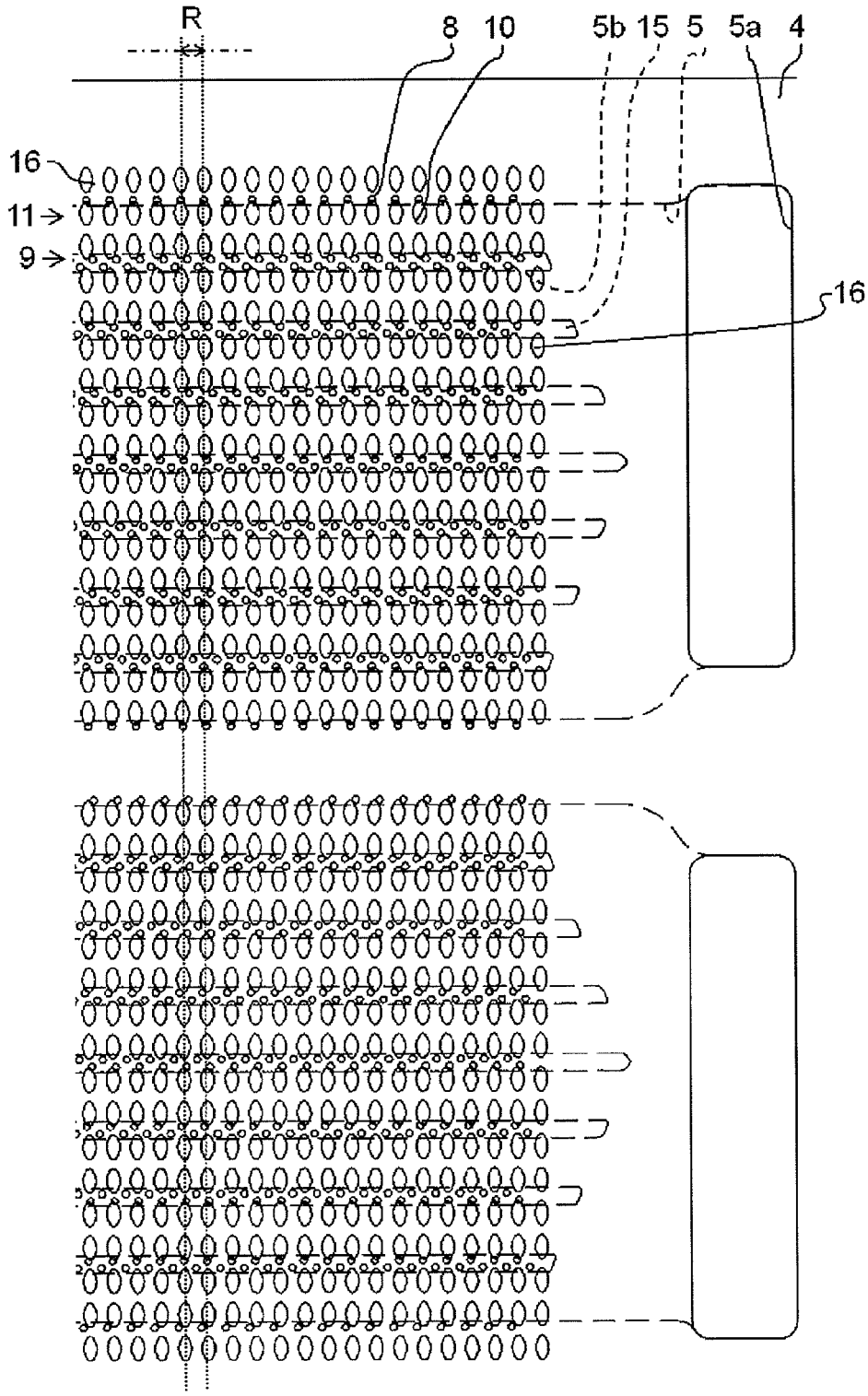
FIG. 4 is another enlarged view of the region in FIG. 2 enclosed in a dotted line, in which a portion of the channel is omitted to simplify the description.
Figure 5:
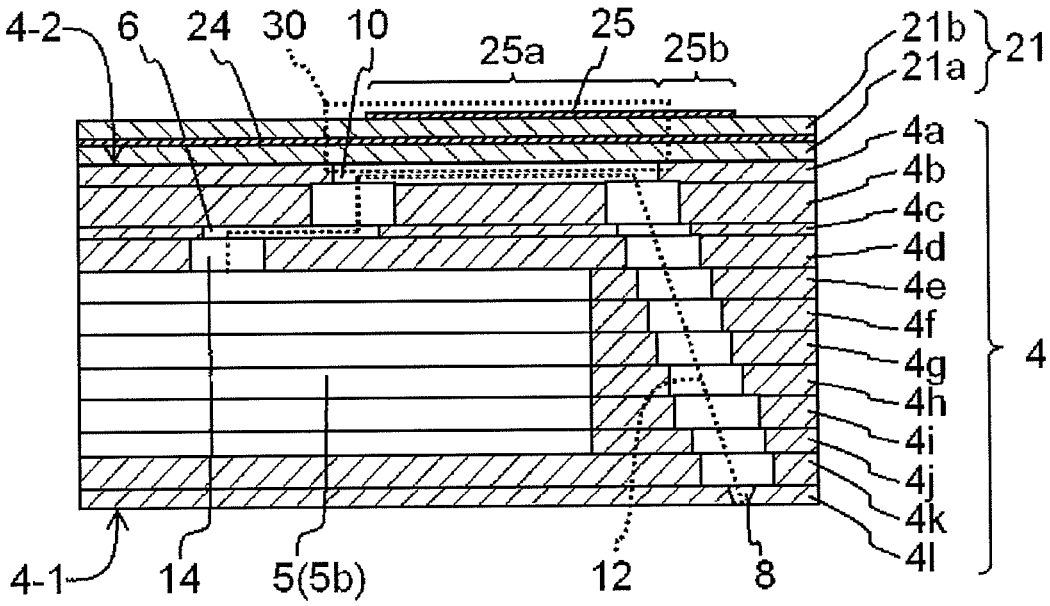
FIG. 5 is a cross-sectional diagram along the line V-V in FIG. 3.
Figure 6:
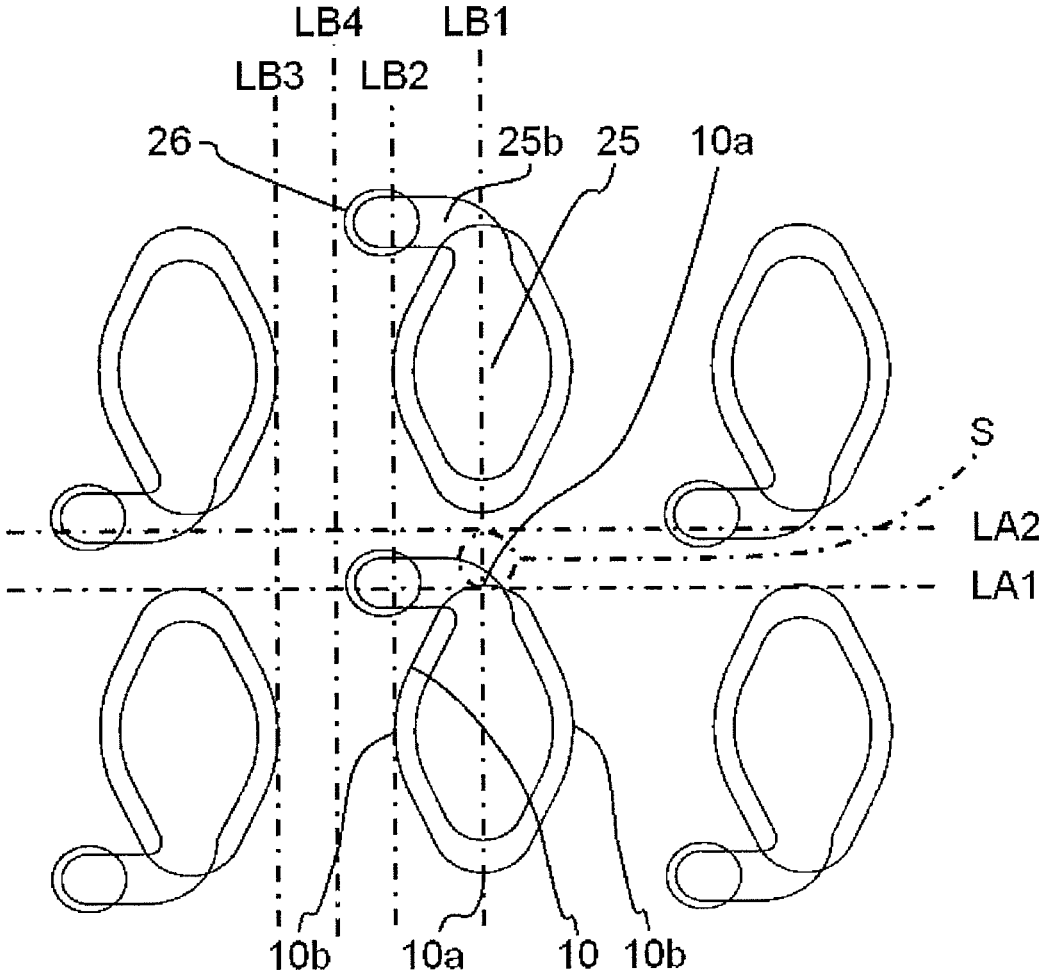
FIG. 6 is an enlarged plan view of the liquid ejecting head illustrated in FIG. 2 through FIG. 5.

Next, the liquid ejecting head 2 according to the present invention will be described. FIG. 2 is a plan view of the head body 2*a*. FIG. 3 is an enlarged view of the region in FIG. 2 enclosed in a dotted line, in which a portion of the channel is removed to simplify the description. FIG. 4 is another enlarged view of the region in FIG. 2 enclosed in a dotted line, in which a portion of the channel different from that of FIG. 3 is removed to simplify the description. A diaphragm 6, the ejection hole 8, and a compression chamber 10 under a piezoelectric actuator substrate 21 are drawn with solid lines instead of dashed lines which they should be drawn with, for the sake of clarity in FIG. 3 and FIG. 4. FIG. 5 is a cross-sectional diagram along the line V-V in FIG. 3. FIG. 6 is an enlarged plan view of the head body 2*a* illustrated in FIG. 2 through FIG. 5, and illustrates the relationship between the compression chamber 10, an independent electrode 25, which is a second electrode, and a connecting electrode 26. The ejection hole 8 in FIG. 4 is drawn with a diameter larger than its actual diameter to help clarify its position.

The liquid ejecting head 2 includes a reservoir and a metal chassis in addition to the head body 2*a*. Also, the head body 2*a* includes a fluid channel member 4 and the piezoelectric actuator substrate 21 which is made with a displacing element (pressurizing unit) 30.

The fluid channel member 4 configuring the head body 2*a* is provisioned with a manifold 5, multiple units of the compression chamber 10 connected to the manifold 5, and multiple units of the ejection hole 8 connected to the multiple units of the compression chamber 10. The compression chamber 10 opens to the top surface of the fluid channel member 4, and the top surface of the fluid channel member 4 forms a compression chamber surface 4-2. The top surface of the fluid channel member 4 includes a hole 5*a* connected to the manifold 5, and liquid is supplied by this hole 5*a*.

The piezoelectric actuator substrate 21 including the displacing element 30 is attached to the top surface of the fluid channel member 4, and each displacing element 30 is arranged so as to be positioned over the compression chamber 10. A signal transmission unit 92 such as a FPC (Flexible Printed Circuit) functioning as a circuit board to supply signals to each displacing element 30 is connected to the piezoelectric actuator substrate 21. The dotted line in FIG. 2 represents the outline near the connection of the signal transmission unit 92 with the piezoelectric actuator substrate 21 to illustrate that two units of the signal transmission unit 92 are connected to the piezoelectric actuator substrate 21. The signal transmission unit 92 is arranged along the piezoelectric actuator substrate 21, and the connection between the signal transmission unit 92 and the piezoelectric actuator substrate 21 exists outside of the compression chamber 10 so as not to restrict the displacement of the displacing element 30. Multiple units of a wiring 92*b* are arranged along the latitudinal direction of the head body 2*a* in the region facing the piezoelectric actuator substrate 21 of the signal transmission unit 92. The wiring 92*b* connects to portions not illustrated on both the right and left sides of FIG. 2. The signals sent from the control unit 100 travel through other circuit boards as necessary before being supplied to the displacing element 30 via the signal transmission unit 92. An electrode making up the end of the wiring 92*b* toward the piezoelectric actuator substrate 21 is electrically connected to the piezoelectric actuator substrate 21, and this electrode is arranged on the end of the signal transmission unit 92 having a rectangular form. The two units of signal transmission unit 92 are connected so that the ends are directed toward the center of the piezoelectric actuator substrate 21 in the latitudinal direction. The two units of the signal transmission unit 92 extend along the long side of the piezoelectric actuator substrate 21 from the center.

A driver IC is implemented to the signal transmission unit 92. The driver IC is implemented so as to push against the metal chassis so that the heat generated by the driver IC is radiated external through the metal chassis. The drive signal for activating the displacing element 30 on the piezoelectric actuator substrate 21 is generated within the driver IC. The signal for controlling generating of the drive signal is generated by the control unit 100, and is input from the end opposite the side connecting the signal transmission unit 92 and the piezoelectric actuator substrate 21. A circuit board may be provisioned as necessary in the liquid ejecting head 2 between the control unit 100 and the signal transmission unit 92.

The head body 2*a* includes the fluid channel member 4 having a plane form, and one piezoelectric actuator substrate 21 including the displacing element 30 connected on top of the fluid channel member 4. The plane form of the piezoelectric actuator substrate 21 is rectangular, and is arranged on the top surface of the fluid channel member 4 so that the long side of this rectangular form lines up with the longitudinal direction of the fluid channel member 4.

Two units of the manifold 5 are formed in the interior of the fluid channel member 4. The manifold 5 has a long and narrow form extending from one end of the fluid channel member 4 in the longitudinal direction to the other end. Supply shortages of the liquid are mostly avoided by supplying liquid to the fluid channel member 4 from both ends of the manifold 5. This configuration may also minimize variances in liquid ejection performance as the difference in stress losses generated when liquid flows from the manifold 5 is reduced by approximately one-half as compared to configuration in which liquid is supplied from only one end of the manifold 5.

The center of the manifold 5 in the length direction, which is the region connected to at least the compression chamber 10, is separated by a partition 15 provisioned to widen a space in the latitudinal direction. The partition 15 has the same height as the manifold 5 at the center in the length direction, which is the region connected to the compression chamber 10, and completely separates the manifold 5 from multiple units of a secondary manifold 5*b*. In this way, a descender connected to the ejection hole 8 and the compression chamber 10 from the ejection hole 8 may be provisioned to overlap the partition 15 when seen from the plan view.

All of the manifold 5 in FIG. 2 is separated by the partition 15, except for the two ends. In addition to this configuration, the partition 15 may also separate one of the ends. A partition may also be provisioned from the hole 5*a* toward the depth direction so that the area near the hole 5*a* hole the top surface of the fluid channel member 4 is not the only area separated. However, channel resistance is reduced by the portions not separated, which increases the amount of liquid supplied, so it is preferable that both ends of the manifold 5 are not separated by the partition 15.

The portions of the manifold 5 that are divided into multiple units are referred to as the secondary manifold 5*b*. According to the present embodiment, the manifold 5 is provisioned as two independent units, and the hole 5*a* is provisioned on both ends of each of these units. Seven units of the partition 15 are provisioned to one manifold 5, and so divided into eight units of the secondary manifold 5*b*. The width of the secondary manifold 5*b* is wider than the width of the partition 15, which enables a significant amount of liquid to flow to the secondary manifold 5*b*. The seven units of the partition 15 become increasingly longer the closer they are to the center in the latitudinal direction. Regarding both ends of the manifold 5, the ends of the partition 15 become increasingly closer to the ends of the manifold 5 the closer each partition 15 is to the center in the latitudinal direction. As a result, a balance is established between the channel resistance generated by the walls external to the manifold 5 and the channel resistance generated by the partition 15, and so the stress differences may be reduced in the liquid at the end of a region formed by an independent supply channel 14, which is the secondary manifold 5*b* connected to the compression chamber 10. The stress difference at this independent supply channel 14 has a relationship with the stress difference added to the liquid in the compression chamber 10, and so variances in ejects may be reduced by reducing the stress differences in the independent supply channel 14.

The fluid channel member 4 is formed with multiple units of the compression chamber 10 spread out two dimensionally. The compression chamber 10 is a hollow region having a plane form in a near-diamond shape formed by two acute angle portions 10*a* and two obtuse angle portions 10*b*, with the angle portions rounded.

The compression chamber 10 is connected to one secondary manifold 5*b* via the independent supply channel 14. A compression chamber row 11, which is a row of multiple units of the compression chamber 10 connected to this secondary manifold 5*b*, is arranged to line up with the secondary manifold 5*b*. A total of two rows of the compression chamber row 11 are provisioned to one secondary manifold 5*b* with one row on each end of the secondary manifold 5*b*. Therefore, there are 16 rows of the compression chamber row 11 provisioned for one manifold 5, which equates to 32 rows of the compression chamber row 11 in total for the head body 2*a*. The spacing between each compression chamber 10 in the longitudinal direction of the compression chamber row 11 is the same distance, which as an example may be 37.5 dpi.

A dummy compression chamber 16 is provisioned to the end of each compression chamber row 11. This dummy compression chamber 16 is connected to the manifold 5, but is not connected to the ejection hole 8. A dummy chamber row is provisioned on both ends of the 32 rows of the compression chamber row 11 forming a straight line of multiple units of the dummy compression chamber 16. These units of the dummy compression chamber 16 are neither connected to the manifold 5 nor the ejection hole 8. These dummy compression chambers enable differences in liquid ejection performance to be reduced as the construction (stiffness) of the perimeter around the first inner compression chamber 10 from the end is closer to the construction (stiffness) of other units of the compression chamber 10. The effect of the difference in the construction of the perimeter produced by the units of the compression chamber 10 which are finely spaced apart and adjacent in the longitudinal direction is significant, and so this is why the dummy compression chambers are provisioned on both ends in the longitudinal direction. The effect is relatively insignificant regarding the latitudinal direction, and so the dummy compression chamber is only provisioned to the end near a head body 21*a*. As a result, the width of the head body 21*a* may be reduced.

The units of the compression chamber 10 connected to one manifold 5 are arranged with the same amount of spacing between them regarding both the row perspective and the column perspective in which the direction of the row is the longitudinal direction of the liquid ejecting head 2, and the direction of the column is the latitudinal direction. The direction of the row is the direction following the diagonal line connecting the pair of obtuse angle portions 10*b* of the diamond-shaped compression chamber 10, and is also the direction connecting the area centroid of the compression chamber 10 arranged so that the pair of obtuse angle portions 10*b* are facing. The length of the edges of the diamond shape of the compression chamber 10 may be different by an amount of around 10 percent. Due to the difference in the length of the edges and the arrangement in which the compression chamber 10 is rotated on a plane, the direction of the row and the direction of the diagonal connecting the pair of the obtuse angle portions 10*b* may form an angle of up to 10 degrees. The direction of the column is the direction along the diagonal connecting the pair acute angle portions 10*a* of the diamond-shaped compression chamber 10, and is also the direction connecting the area centroid of the compression chamber 10 arranged so that the pair of acute angle portions 10*a* are facing. Due to the difference in the length of the edges and the arrangement in which the compression chamber 10 is rotated on a plane, the direction of the column and the direction of the diagonal connecting the pair of the acute angle portions 10*a* may form an angle of up to 10 degrees. That is to say, the angles that the direction of the row and the direction of the column form with the diagonals of the diamond shape of the compression chamber 10 are small. Crosstalk may be reduced by arranging the compression chamber 10 having a diamond shape with such angles in a grid pattern. By having the diagonals facing on both the direction of the row and the direction of the column instead of the edges, vibration is not readily transferred into one compression chamber 10 from the fluid channel member 4. Having the pair of obtuse angle portions 10*b* facing in the longitudinal direction enables the units of the compression chamber 10 to be arranged more densely in the longitudinal direction, which in turn enables a denser arrangement of the ejection holes 8 in the longitudinal direction, which ultimately enables a high-resolution liquid ejecting head 2. Crosstalk may be reduced when the spacing between the units of the compression chamber 10 in the row perspective and the column perspective is fixed at a set amount which does away with instances in which the spacing is narrower than other spacings, but the spacing may be different by approximately ±20%.

By arranging the compression chamber 10 in a grid pattern and arranging the piezoelectric actuator substrate 21 having a square form with outer edges along the row and column, the independent electrode 25 formed above the compression chamber 10 are arranged in equal distance from the outer edge of the piezoelectric actuator substrate 21. Thus, deformations in the piezoelectric actuator substrate 21 occur less readily when forming the independent electrode 25. When the piezoelectric actuator substrate 21 and the fluid channel member 4 are joined, stress is applied to the displacing element 30 close to the outer edge when this deformation is significant, which may cause variances in deformation performance, but these variances may be reduced by reducing the deformation. The effect of deformations is further mitigated by the provisioning of the dummy compression chamber row of the dummy compression chamber 16 at the outer edge of the compression chamber row 11. The units of the compression chamber 10 belonging to the compression chamber row 11 are arranged at even spacings, and the units of the independent electrode 25 corresponding to the compression chamber row 11 are also arranged at even spacings. The compression chamber row 11 is arranged at even spacings in the latitudinal direction, and the column of the independent electrode 25 corresponding to the compression chamber row 11 is arranged at even spacings in the latitudinal direction. As a result, regions where the effect of crosstalk is particularly significant may be removed.

When viewing the fluid channel member 4 from a plan view, the units of the compression chamber 10 belonging to one compression chamber row 11 and the units of the compression chamber 10 belonging to the adjacent compression chamber row 11 are arranged not to overlap in the longitudinal direction of the liquid ejecting head 2, which may suppress crosstalk. Conversely, if the compression chamber row 11 is separated by a distance, the width of the liquid ejecting head 2 increases, and so the precision of the arrangement angles of the liquid ejecting head 2 in correspondence with the printer 1 and the precision of the relative positions of the liquid ejecting head 2 when using multiple units of the liquid ejecting head 2 has a significant effect on the printing result. This effect of these precision issues on the printing result may be reduced by making the width of the partition 15 smaller than the secondary manifold 5*b*.

The units of the compression chamber 10 connected to one secondary manifold 5*b* configure two rows of the compression chamber row 11, and the units of the ejection hole 8 connecting from the units of the compression chamber 10 belonging to the one compression chamber row 11 configure one ejection hole row 9. The units of the ejection hole 8 connected to the units of the compression chamber 10 belonging to the two rows of the compression chamber row 11 open to different sides of the secondary manifold 5*b*. Two rows of the ejection hole row 9 are provisioned on the partition 15 as in FIG. 4, but the units of the ejection hole 8 belonging to the rows of the ejection hole row 9 are connected to the side of the secondary manifold 5*b* near the ejection hole 8 via the compression chamber 10. Crosstalk is further reduced by suppressing crosstalk between channels connecting the compression chamber 10 and the ejection hole 8 with the arrangement of the units of the ejection hole 8, which are connected to the adjacent secondary manifold 5*b* via the compression chamber row 11, not overlapping in the longitudinal direction of the liquid ejecting head 2. Crosstalk may be further reduced by arranging the entire channel connecting the compression chamber 10 and the ejection hole 8 so as to not overlap in the longitudinal direction of the liquid ejecting head 2.

The width of the liquid ejecting head 2 may be reduced by arranging the compression chamber 10 and the secondary manifold 5*b* to overlap in the plan view. The width of the liquid ejecting head 2 may be further reduced by increasing the ratio of area overlapping the area of the compression chamber 10 to 80% or more, and further to 90% or more. The stiffness of the bottom surface of the compression chamber 10 of the portion that is overlapping with the secondary manifold 5*b* is lower in comparison when not overlapping with the secondary manifold 5*b*, and this difference may cause variances in the ejection performance. The variances in the ejection performance caused by different levels of stiffness in the bottom surface configuring the compression chamber 10 may be reduced by having nearly the same ratio corresponding to the total area of the area of the compression chamber 10 that overlaps with the secondary manifold 5*b* for each unit of the compression chamber 10. Nearly the same ratio here refers to a difference in the ratio of area of no more than 10%, and preferably, no more than 5%.

A group of compression chambers is configured by the multiple units of the compression chamber 10 connected to one manifold 5, and so there are two compression chamber groups as there are two units of the manifold 5. The arrangement of the units of the compression chamber 10 involved in the ejection within each compression chamber group moves together in parallel in the latitudinal direction. These units of the compression chamber 10 are arranged over nearly the entire surface of the region corresponding to the piezoelectric actuator substrate 21, which is on the top surface of the fluid channel member 4 even though there is a portion in which spacings such as those between the compression chamber groups are widened. That is to say, the compression chamber group formed with the units of the compression chamber 10 occupies a region of nearly the same size and form as the piezoelectric actuator substrate 21. The holes of each compression chamber 10 are closed by the joining of the piezoelectric actuator substrate 21 to the top surface of the fluid channel member 4.

A descender connected to the ejection hole 8 which opens to an ejection hole surface 4-1 on the lower surface of the fluid channel member 4 extends from the angle portion opposing the angle portion connecting with the independent supply channel 14 of the compression chamber 10. The descender extends in the direction away from the compression chamber 10 when viewing from the plan view. Specifically, the descender extends away from the direction along the long diagonal of the compression chamber 10 while moving to the right and left of this direction. As a result, the ejection hole 8 may be arranged at spacings resulting in a total resolution of 1200 dpi while the compression chamber 10 is arranged in a grid pattern with their spacings within the compression chamber row 11 set to 37.5 dpi.

To word this differently, if the ejection hole 8 is projected to intersect an imaginary straight line running parallel with the longitudinal direction of the fluid channel member 4, then the 32 units of the ejection hole 8 as the total of 16 units of the ejection hole 8 connected to each manifold 5 have even spacings of 1200 dpi in the range defined by the R of the imaginary straight line illustrated in FIG. 4. As a result, an image may be formed in its entirety at a resolution of 1200 dpi in the longitudinal direction by supplying ink of the same color to all units of the manifold 5. One unit of the ejection hole 8 connected to one manifold 5 has an even spacing of 600 dpi in the range defined by the R of the imaginary straight line. As a result, an image of two colors may be formed in its entirety at a resolution of 600 dpi in the longitudinal direction by supplying ink of different colors to each manifold 5. In this case, using two units of the liquid ejecting head 2 enables an image of four colors to be formed at a resolution of 600 dpi, which increases the printing accuracy and enables simple printing settings in comparison with using a liquid ejecting head capable of printing at 600 dpi.

A reservoir may connected to the fluid channel member 4 in the liquid ejecting head 2 to stabilize the supply of liquid from the hole 5*a* in the manifold. Provisioning two channels connected to the hole 5*a* to bifurcate the liquid supplied externally enables the liquid to be supplied to the two holes in a stable manner. Variances in the ejection performance of droplets from the liquid ejecting head 2 may be further reduced by an equal length of the channels from the bifurcation as changes in temperature and stress in the liquid supplied externally is then transferred to the hole 5*a* at both ends of the manifold 5 with little difference in time. The provisioning of a damper in the reservoir may further stabilize the supply of liquid. A filter may also be provisioned to suppress impurities and such in the liquid from flowing toward the fluid channel member 4. A heater may also be provisioned to stabilize the temperature of the liquid flowing toward the fluid channel member 4.

The independent electrode 25 is formed on the top surface of the piezoelectric actuator substrate 21 at positions facing to each compression chamber 10. The independent electrode 25 is somewhat smaller than the compression chamber 10, and includes an independent main electrode (main electrode) 25*a* having a form nearly identical to the compression chamber 10 and a lead-out electrode 25*b* led out from the independent main electrode 25*a*. The independent electrode 25 configures independent electrode rows and independent electrode groups in the same way as the compression chamber 10. One end of the lead-out electrode 25*b* is connected to the independent main electrode 25*a*, and the other end is led out through the acute angle portion 10*a* of the compression chamber 10 to a region outside of the compression chamber 10 not overlapping with a column that extends the diagonals connecting the two acute angle portions 10*a* of the compression chamber 10. As a result, crosstalk may be reduced. The form of the lead-out electrode 25*b* will be described later.

A shared electrode 24, which is a first electrode, and a shared-electrode surface electrode 28 electrically connected via a via hole are formed on the top surface of the piezoelectric actuator substrate 21. Two rows of the shared-electrode surface electrode 28 are formed along the longitudinal direction in the center of the piezoelectric actuator substrate 21 in the latitudinal direction, and one row of the shared-electrode surface electrode 28 is formed along the latitudinal direction near the end in the longitudinal direction. The illustrated shared-electrode surface electrode 28 is formed intermittently on a straight line.

The piezoelectric actuator substrate 21 is preferably laminated with a piezoelectric ceramic layer 21*a* forming the via hole described later, the shared electrode 24, and a piezoelectric ceramic layer 21*b*, and then the independent electrode 25 and the shared-electrode surface electrode 28 are formed together during the same process after the firing. If the piezoelectric actuator substrate 21 is fired after the independent electrode 25 is formed, the piezoelectric actuator substrate 21 may warp. Stress is applied to the piezoelectric actuator substrate 21 when a warped piezoelectric actuator substrate 21 is joined to the fluid channel member 4. Because of this and the significant effect on ejection performance caused by variances in the positioning of the independent electrode 25 and the compression chamber 10, the independent electrode 25 is formed after the firing. The independent electrode 25 and the shared-electrode surface electrode 28 are formed together during the same process as the shared-electrode surface electrode 28. The reasons are that the shared-electrode surface electrode 28 may also exhibit warpage, and that forming the shared-electrode surface electrode 28 together with the independent electrode 25 at the same time improves positional accuracy and simplifies the forming process.

Variances in the position of the via hole may be caused by shrinkage during the firing of the piezoelectric actuator substrate 21. These variances mainly occur in the longitudinal direction of the piezoelectric actuator substrate 21, and may separate the electrical connection between the via hole and the shared-electrode surface electrode 28 due to positional offset therebetween. This may be circumvented by provisioning the shared-electrode surface electrode 28 in the center of the even number of units of the manifold 5 in the latitudinal direction and by forming the shared-electrode surface electrode 28 with a long form in the longitudinal direction of the piezoelectric actuator substrate 21.

Two units of the signal transmission unit 92 are joined to the piezoelectric actuator substrate 21 in an arrangement from the two long edges of the piezoelectric actuator substrate 21 toward the center. Connections may be readily performed at this time by forming and connecting a connecting electrode 26 and a shared-electrode connecting electrode on the lead-out electrode 25*b* of the piezoelectric actuator substrate 21*a* and the shared-electrode surface electrode 28. If the area of the shared-electrode surface electrode 28 and the shared-electrode connecting electrode is made larger than the area of the connecting electrode 26 at this time, the connecting at the end of the signal transmission unit 92 (the leading end and the end in the longitudinal direction of the piezoelectric actuator substrate 21) may be made stronger than the connections to the shared-electrode surface electrode 28, which helps prevent peeling of the signal transmission unit 92 from the end.

The ejection hole 8 is arranged in a position avoiding the region facing the manifold 5, which is arranged to the lower surface of the fluid channel member 4. The ejection hole 8 is arranged in the region facing the piezoelectric actuator substrate 21 regarding the lower surface of the fluid channel member 4. These units of the ejection hole 8 form a group occupying a region having nearly the same size and form as the piezoelectric actuator substrate 21. Droplets are ejected from the ejection hole 8 by the displacement caused by the displacing element 30 on the corresponding piezoelectric actuator substrate 21.

The fluid channel member 4 included in the head body 2*a* has a laminated construction of multiple layers of plates. In order from the top surface of the fluid channel member 4, these plates include a cavity plate 4*a*, a base plate 4*b*, an aperture (diaphragm) plate 4*c*, a supply plate 4*d*, manifold plates 4*e* through 4*j*, a cover plate 4*k*, and a nozzle plate 41. Multiple holes are formed in these plates. Configuring the thickness of each plate at range between 10 to 300 μm improves the precision when forming the holes. Each plate is positioned and layers so that the holes connect to configure an independent channel 12 and the manifold 5. The head body 2*a* is configured so that the compression chamber 10 is arranged to the upper surface of the fluid channel member 4, the manifold 5 to the lower surface within the fluid channel member 4, and the ejection hole 8 to the lower surface in which each portion configuring the independent channel 12 is arranged adjacent to each other at different positions, which connects the manifold 5 and the ejection hole 8 via the compression chamber 10.

The holes formed on each plate will be described, which include the following types. A first hole is the compression chamber 10 formed in the cavity plate 4*a*. A second hole is a communication hole configuring the independent supply channel 14 connecting to the manifold 5 from one end of the compression chamber 10. This communication hole is formed on each plate from the base plate 4*b* (specifically, the entrance of the compression chamber 10) to the supply plate 4*c* (specifically, the exit of the manifold 5). The independent supply channel 14 includes the diaphragm 6, which is the area of the channel with a smaller cross-sectional area formed in the supply plate 4*c*.

A third hole is a communication hole configuring the channel passing from one end of the compression chamber 10 to the ejection hole 8, and this communication hole is referred to as the descender (portional channel) described later. The descender is formed on each plate from the base plate 4*b* (specifically, the exit of the compression chamber 10) to the nozzle plate 41 (specifically, the ejection hole 8). The hole in the nozzle plate 41 functions as the ejection hole 8 having a diameter between 10 to 40 μm, for example, that opens to the outside of the fluid channel member 4, increasing in diameter toward the inside. A fourth hole is a via hole configuring the manifold 5. This via hole is formed on the manifold plates 4*e* through 4*j*. The holes are formed on the on the manifold plates 4*e* through 4*j* so that the partition 15 remains so as to configure the secondary manifold 5*b*. The partition 15 regarding each manifold plate 4*e* through 4*j* is in an unsupportable state is the entire portion forming the manifold 5 is made as a hole, and so the partition 15 is connected to the outer perimeter of each manifold plate 4*e* through 4*j* by a half-etched tab.

The first through fourth via holes are mutually connected, and configure the independent channel 12 extending from the inlet for the liquid from the manifold 5 (exit of the manifold 5) to the ejection hole 8. The liquid supplied to the manifold 5 is ejected from the ejection hole 8 through the following path. First, the liquid travels upward from the manifold 5, enters the independent supply channel 14 toward one end of the diaphragm 6. Next, the liquid proceeds horizontally along the extended direction of the diaphragm 6 to the other end of the diaphragm 6. The liquid then travels upward toward one end of the compression chamber 10. The liquid proceeds horizontally along the extended direction of the compression chamber 10 toward the other end of the compression chamber 10. The liquid then slowly travels horizontally toward the lower side mainly proceeding to the ejection hole 8 opened to the lower surface.

The piezoelectric actuator substrate 21 has a laminated construction made from two units of the piezoelectric ceramic layer 21*a* and 21*b*, which are piezoelectric bodies. The piezoelectric ceramic layer 21*a* and 21*b* have a thickness of approximately 20 μm each. The thickness from the lower surface of the piezoelectric ceramic layer 21*a* of the piezoelectric actuator substrate 21 to the upper surface of the piezoelectric ceramic layer 21*b* is approximately 40 μm. Either layer of the piezoelectric ceramic layer 21*a* and 21*b* extend crossing over the multiple units of the compression chamber 10. The piezoelectric ceramic layer 21*a* and 21*b* are made from ceramic materials such as lead zirconate titanate (PZT) having ferroelectric properties.

The piezoelectric actuator substrate 21 includes the shared electrode 24 made from metallic materials such as Ag—Pd and the independent electrode 25 made from metallic materials such as Au. The independent electrode 25 includes the independent main electrode 25*a* disposed at a position facing the compression chamber 10 regarding the upper surface of the piezoelectric actuator substrate 21 as previously described, and the lead-out electrode 25*b* led out from there. The connecting electrode 26 is formed in the portion of the end of the lead-out electrode 25*b* led out away from the region facing the compression chamber 10. The connecting electrode 26 is made from a silver and palladium alloy including glass frit, for example, and formed convexly with a thickness of approximately 15 μm. The connecting electrode 26 is electrically connected to an electrode provisioned on the signal transmission unit 92. Details will be described later, but drive signals are supplied to the independent electrode 25 from the control unit 100 through the signal transmission unit 92. The drive signals are supplied at regular cycles synchronized with the conveyance speed of the printing paper P.

The shared electrode 24 is formed across nearly the entire surface toward the surface on a region between the piezoelectric ceramic layer 21*a* and the piezoelectric ceramic layer 21*b*. That is to say, the shared electrode 24 extends so as to cover all units of the compression chamber 10 within a range facing the piezoelectric actuator substrate 21. The thickness of the shared electrode 24 is approximately 2 μm. The shared electrode 24 is grounded and holds a ground voltage connecting to the shared-electrode surface electrode 28, which is formed at a position avoiding an electrode group made from units of the independent electrode 25 on the piezoelectric ceramic layer 21*b*, via the via hole. The shared-electrode surface electrode 28 is connected to a different electrode on the signal transmission unit 92 similar to the multiple units of the independent electrode 25.

A predetermined drive signal is selectively supplied to the independent electrode 25, which changes the volume in the compression chamber 10 corresponding to this independent electrode 25, and applies pressure to the liquid in the compression chamber 10, which will be described later. As a result, droplets are ejected from the corresponding ejection hole 8 through the independent channel 12. That is to say, the portion regarding the piezoelectric actuator substrate 21 facing each compression chamber 10 corresponds to an individual displacing element 30 corresponding to each compression chamber 10 and liquid ejection hole 8. That is to say, the displacing element 30, which is the piezoelectric actuator functioning as a unit structure constructed as illustrated in FIG. 5 within the laminated body made from the two units of the piezoelectric ceramic layer 21*a* and 21*b*, is made for each compression chamber 10 by the vibrating plate 21*a* positioned directly above the compression chamber 10, the shared electrode 24, the piezoelectric ceramic layer 21*b*, and the independent electrode 25. Multiple units of the displacing element 30, which functions as a compression unit, are included on the piezoelectric actuator substrate 21. According to the present embodiment, the amount of liquid ejected from the liquid ejection hole 8 by one ejection operation is approximately 1.5 to 4.5 pl (picoliters).

The multiple units of the independent electrode 25 are each electrically connected electrically to the control unit 100 via the signal transmission unit 92 and a wiring, so that the potential thereof can be individually controlled. When independent electrode 25 is given a different potential than the shared electrode 24, and an electric field is applied to the piezoelectric ceramic layer 21*b* in the direction of polarization, the to which this electric field is applied functions as active unit that strains due to the piezoelectric effect. When the independent electrode 25*a* is set by the control unit 100 to a predetermined voltage that is either positive or negative in correspondence with the shared electrode 24 so that the electric field and polarization are in the same direction in this configuration, the portion sandwiched in the electrodes of the piezoelectric ceramic layer 21*b* (active unit) shrinks in the planar direction. Conversely, the inactive layers of the piezoelectric ceramic layer 21*a* are not affected by the electric field, and so attempt to regulate the displacement of the active unit without voluntary shrinkage. As a result, there is a difference in strain toward the direction of polarization between the piezoelectric ceramic layer 21*b* and the piezoelectric ceramic layer 21*a*, which causes the piezoelectric ceramic layer 21*b* to be displaced so as to convex toward the compression chamber 10 (unimorph displacement).

The actual drive process according to the present embodiment sets the independent electrode 25 to a voltage higher than (hereafter, high voltage) the shared electrode 24 beforehand, temporarily sets the independent electrode 25 to the same voltage (hereafter, low voltage) as the shared electrode 24 every time there is an ejection request, and afterwards resets the independent electrode 25 to the high voltage at a predetermined timing. As a result, the piezoelectric ceramic layer 21*a* and the piezoelectric ceramic layer 21*b* return to their original form at the timing when independent electrode 25 is at the low voltage, and the volume of the compression chamber 10 increases in comparison to the initial state (when voltage of both electrodes is different). At this time, negative pressure is created in the compression chamber 10 suctioning liquid into the compression chamber 10 from the manifold 5. The piezoelectric ceramic layer 21*a* and 21*b* displace convexly toward the compression chamber 10 at the timing when the independent electrode 25 is again at the high voltage, which causes the pressure in the compression chamber 10 to change to positive pressure due to the reduction in volume in the compression chamber 10. This increases the stress of the liquid, causing the droplet to be ejected. That is to say, a drive signal including pulse in which the high voltage is the reference is supplied to the independent electrode 25 in order to eject the droplet. The ideal pulse width is the AL (Acoustic Length), which is the length of time for the compression wave to propagate from the diaphragm 6 to the ejection hole 8. As a result, the two stresses are combined when the state inside the compression chamber 10 changes from negative pressure to positive pressure, in which a stronger stress causes the droplet to be ejected.

Gradation printing is performed by a gradation expression of the droplet amount (volume) adjusted by the number of droplets consecutively ejected from the ejection hole 8, that is to say, the droplet ejection count. For this reason, the number of droplets to be ejected corresponding to the specified gradation expression are consecutively ejected from the ejection hole 8 corresponding to the specified dot region. It is generally preferable for the intervals between pulses supplied to eject the droplets, when consecutively ejection droplets in this way, to be the AL. As a result, the cycles of the decaying stress wave generated by the previous ejection of droplets and the stress wave generated by the following ejection of droplets match, and so the stress waves superimpose to amplify the stress for ejecting droplets. The speed of droplets ejected afterwards may be assumed to increase, which is preferable since points of impact regarding multiple droplets become closer.

Crosstalk as previously described regarding the liquid ejecting head 2 will be described in detail now. As previously described, crosstalk generated from the vibration of one compression chamber 10 propagating to an adjacent compression chamber 10 through the fluid channel member 4 may be reduced by arranging the diamond-shaped compression chamber 10 in a grid pattern such that the diagonals are facing from the plan view.

The arrangement of the lead-out electrode 25*b* also affects crosstalk. The piezoelectric ceramic layer 21*b* directly under the lead-out electrode 25*b* is polarized so that the piezoelectric actuator substrate 21*b* directly under the lead-out electrode 25*b* also displaces due to the piezoelectric effect when voltage is applied to the independent main electrode 25*a*. This simplifies the construction of the displacing element 30 and the manufacturing process of the piezoelectric actuator substrate 21.

The piezoelectric displacement of the piezoelectric ceramic layer 21*b* directly under the lead-out electrode 25*b* in the compression chamber 10 affects the amount of displacement of the displacing element 30. For example, when the piezoelectric ceramic layer 21*b* directly under the independent main electrode 25*a* is made to shrink in the planar direction and the displacing element 30 is squeezed toward the compression chamber 10, the piezoelectric ceramic layer 21*b* directly under the lead-out electrode 25*b* in the compression chamber 10 also shrinks in the planar direction, which reduces the amount of displacement. This reduction in the displacement amount may be reduced by leading out the lead-out electrode 25*b* from the acute angle portion 10*a* regarding the compression chamber 10*b*. This reduces the decrease in the amount of displacement resulting from aligning the displacement of the displacing element 30 to the intended deformation direction when the piezoelectric ceramic layer 21*b* directly under the independent main electrode 25*a* deforms in the planar direction. The amount of displacement of the displacing element 30 reduces even when the same amount of deforming force is generated due to the deformation of the piezoelectric ceramic layer 21*b* occurring near the acute angle portion 10*a*. Conversely, the decrease in the amount of displacement resulting from aligning the displacement of the displacing element 30 to the intended deformation direction increases when the lead-out electrode 25*b* is led out from a point on the edge of the diamond shape of the compression chamber 10. The amount of displacement decreases by approximately 1%, for example, when the lead-out electrode 25*b* regarding the displacing element 30 having the planar form illustrated in FIG. 6 is led out from a point on the edge in comparison to the case when the lead-out electrode 25*b* is led out from the acute angle portion 10*a*.

As the piezoelectric ceramic layer 21 directly under the lead-out electrode 25*b* led out externally from the compression chamber 10 also deforms due to the piezoelectric effect, this has an effect on the displacement of the adjacent displacing element 30. This effect is sometimes due to stress is applied to the piezoelectric ceramic layer 21*b* regarding the adjacent displacing element 30 when the piezoelectric ceramic layer 21*b* directly under the lead-out electrode 25*b* shrinks in the planar direction as the piezoelectric ceramic layer 21*b* is formed to cover the multiple units of the compression chamber 10. The reduction in crosstalk described later is particularly useful for the piezoelectric actuator substrate 21 connected by the space of the displacing element 30 adjacent to the piezoelectric ceramic layer 21*b*.

Next, the form of the independent electrode 25 will be described using the independent electrode 25 in the lower center of FIG. 6. The lead-out electrode 25*b* led out from the acute angle portion 10*a* of the independent electrode 25 has to be led out to a positioned separated from a certain compression chamber 10 when securing a portion functioning as a terminal of certain area to connect to the exterior. In this case, crosstalk is reduced configuring one end of the lead-out electrode 25*b* connecting to the independent main electrode 25*a* and the other end on the other side from overlapping with the column extending through the diagonal connecting the pair of acute angle portions 10*a* (imaginary line LB1), which increases the distance of space with the displacing element 30 adjacent to the side of the acute angle portion 10*a*. The lead-out electrode 25*b* is led out curving away from the direction of the column, which is the direction when led out from the acute angle portion 10*a*, toward the direction of the row. The lead-out electrode 25*b* in FIG. 6 is led out with a curve of approximately 90 degrees to align with the direction of the row, but the angle of this curve may be less than 90 degrees or may be more than 90 degrees.

Crosstalk may be reduced particularly by arranging the lead-out electrode 25*b* to pass through one of the acute angle portions 10*a* of the compression chamber 10 from which the lead-out electrode 25*b* is led out along the imaginary line LA1 parallel to the diagonal connecting the pair of obtuse angle portions 10*b* of the compression chamber 10 or closer to the compression chamber 10 than the imaginary line LA1, which increases the distance between the lead-out electrode 25*b* and the compression chamber 10 adjacent at the side of the acute angle portion 10*a*. More specifically, crosstalk may be reduced by moving the entire lead-out electrode 25*b* farther away from the compression chamber 10 adjacent at the side of the acute angle portion 10*a* than the portion of the other end (end of the lead-out electrode 25*b* that is led out normally functioning as a terminal) of the lead-out electrode 25*b* having the same form S (here, a circle) that is closest to the compression chamber 10 adjacent at the side of the acute angle portion 10*a* when this form S portion of the lead-out electrode 25*b* is arranged before the acute angle portion 10*a* in comparison to the distance from the compression chamber 10 adjacent at the side of the acute angle portion 10*a*. Crosstalk may be reduced by increasing the distance (an arrangement closer to the compression chamber 10 side of the extraction than the LA2) of the lead-out electrode 25*b* from the compression chamber 10 adjacent on the side of the acute angle portion 10*a* larger than the configuration in which the terminal is right next to the acute angle portion 10*a* of the compression chamber 10.

Crosstalk with the displacing element 30 adjacent on the side of the obtuse angle portions 10*b* is reduced by forming the lead-out electrode 25*b* in a region closer to the compression chamber 10 from which the lead-out electrode 25*b* is led out than the compression chamber 10 adjacent on the side of the obtuse angle portions 10*b* regarding the compression chamber 10 from which the lead-out electrode 25*b* is led out. More specifically, when referencing the imaginary line LB2 running through the obtuse angle portion 10*b* of the compression chamber 10 from which the lead-out electrode 25*b* is led out and parallel with the diagonal connecting the pair of acute angle portions 10*a*, the imaginary line LB3 running through the obtuse angle portions 10*b* of the adjacent compression chamber 10 and parallel with the imaginary line LB2, the lead-out electrode 25*b* is arranged in a region closer to the compression chamber 10 from which the lead-out electrode 25*b* is led out than the imaginary line LB4 between these imaginary lines.

Figure 7:
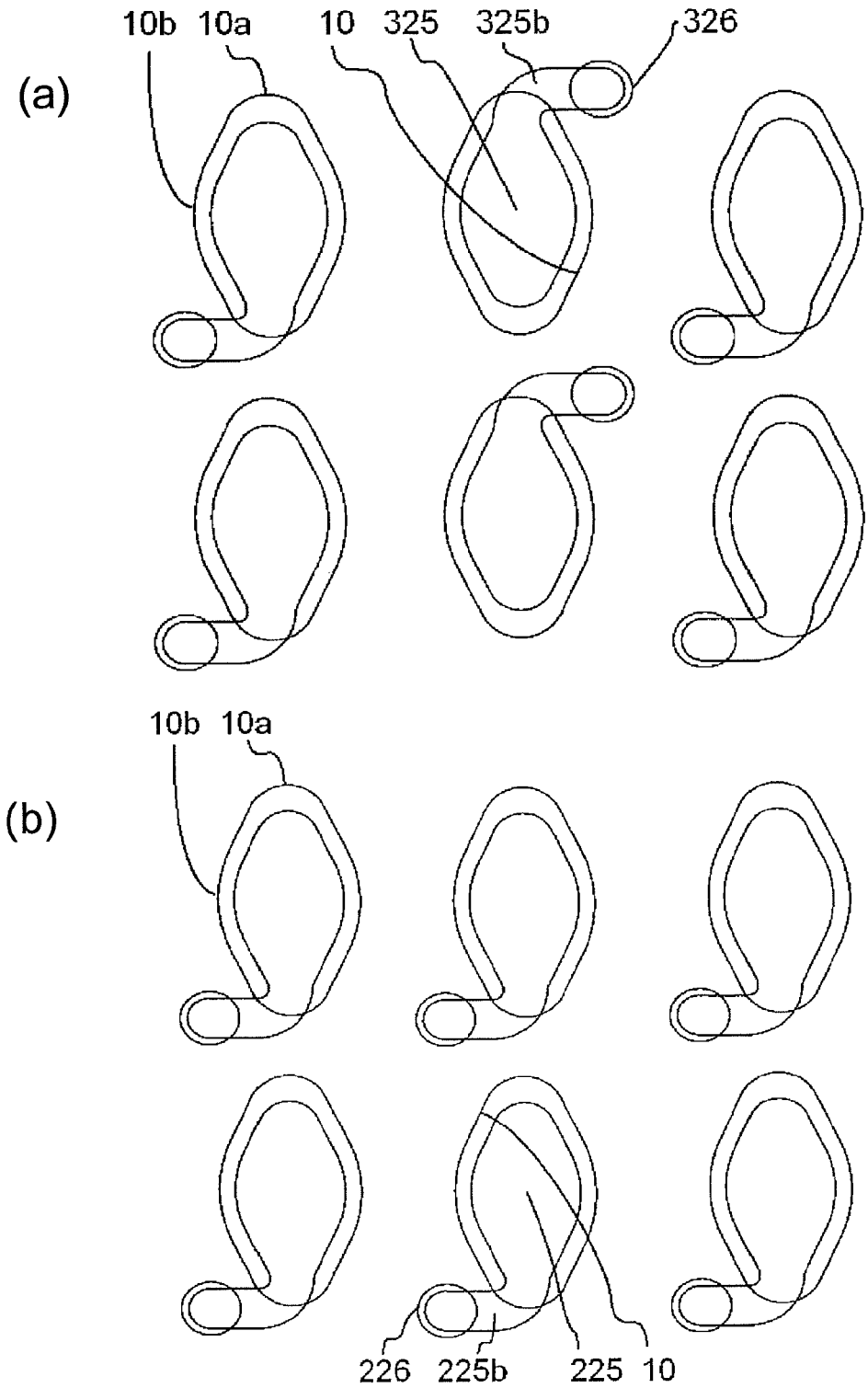
FIGS. 7(*a*) and (*b*) are enlarged plan views of the liquid ejecting head according to another embodiment of the present invention.

The led out direction and curvature thereof regarding a lead-out electrode 225*b* and 325*b*, which are portions of an independent electrode 225 and 325 regarding the multiple units of the compression chamber 10 will be described using FIGS. 7(*a*) and (*b*). FIGS. 7(*a*) and (*b*) are enlarged plan views of the liquid ejecting head, the contents of which are the same the liquid ejecting head 2 illustrated in FIG. 2 through FIG. 4 except for the leading out of the lead-out electrode 225*b* and 325*b*. The liquid ejecting head in FIGS. 7(*a*) and (*b*) reduces crosstalk by satisfying the conditions regarding the previously described lead-out electrode 25*b*.

The lead-out electrode 25*b* and 225*b* in FIG. 6 and FIG. 7(*a*) curve to the same side (left side of the drawings) after being led out from the acute angle portion. This increases the distance in the space of the portion of the end of the lead-out electrode 25*b* and 225*b* functioning as a terminal, which decreases the likelihood of shorts in the lead-out electrode 25*b* and 225*b*, and simplifies connection to the exterior.

Crosstalk is reduced with the lead-out electrode 25*b* in FIG. 6 as follows. At compression chambers 10 adjacent at the acute angle portions 10*a*, the lead-out electrode 25*b* is led out from, of the two acute angle portions 10*a*, the acute angle portions 10*a* on the same side, and also, at compression chambers 10 adjacent at the obtuse angle portions 10*b*, the lead-out electrode 25*b* is led out from, of the two acute angle portions 10*a*, acute angle portions 10*a* on different sides. Arranging a pair of the lead-out electrode 25*b* so as to be separated by a distance reduces the crosstalk created by the stress created from the piezoelectric deformation of the piezoelectric ceramic layer 21*b* directly under the one lead-out electrode 25*b* propagates to the other lead-out electrode 25*b*, which causes a difference in voltage in the other lead-out electrode 25*b*.

Figure 8:
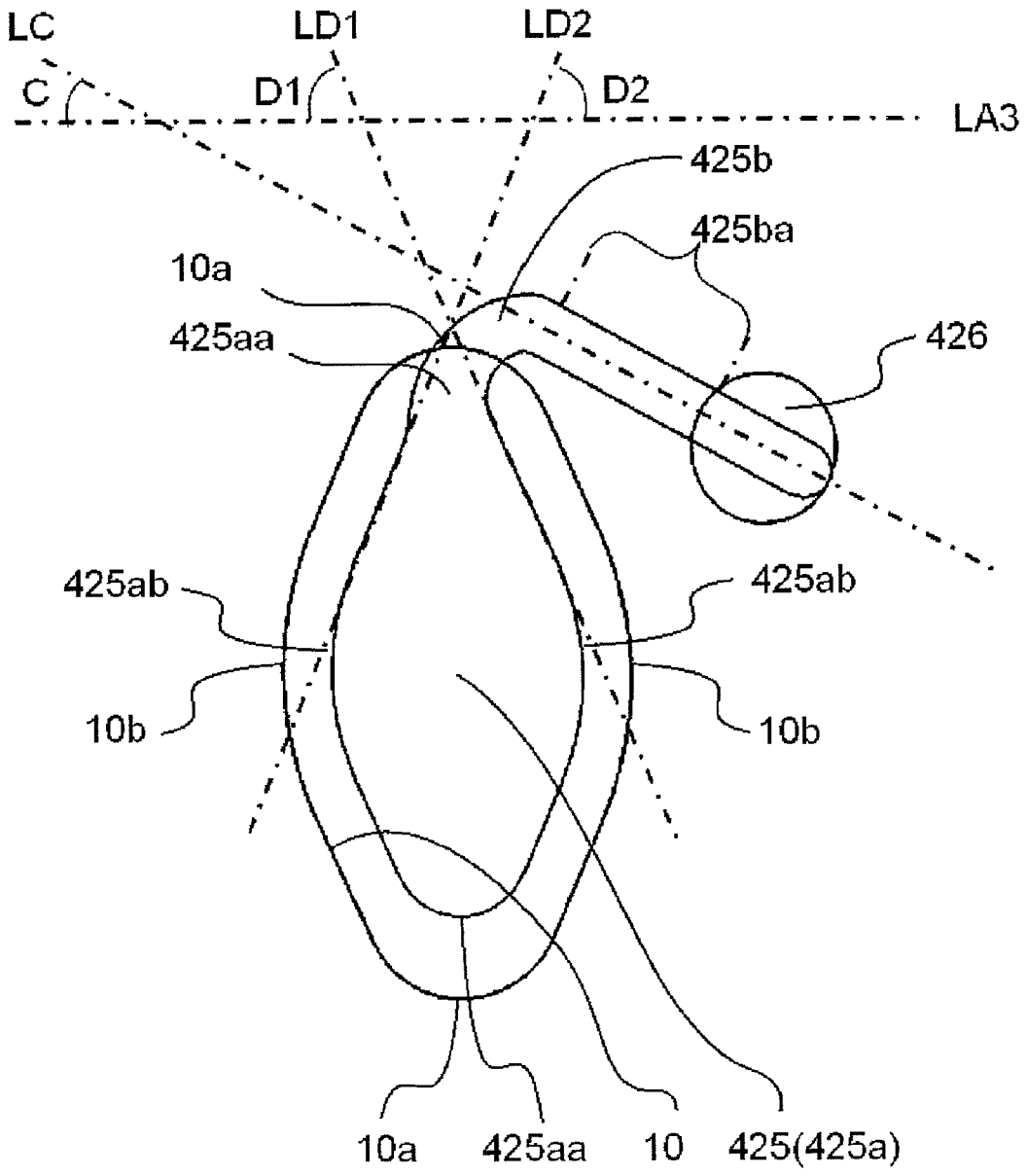
FIG. 8 is a plan view of an independent electrode and compression chamber according to another embodiment of the present invention.

FIG. 8 is a plan view of an independent electrode 425, which represents the other embodiment of the present invention. The form of the independent electrode 425 may be applied to the liquid ejecting head 2 illustrated in FIG. 1 through FIG. 5, and may be applied to either arrangement in FIG. 6 and in FIGS. 7(*a*) and (*b*).

The independent electrode 425 includes an independent main electrode 425*a* contained in the compression chamber 10 when viewing from a plan view, and a lead-out electrode 425*b* led outside of the compression chamber 10 from the independent main electrode 425*a*.

The independent main electrode 425*a* has a diamond shape including two acute angle portions 425*aa* and two obtuse angle portions 425*ab*. The line connecting the two acute angle portions 425*aa* of the independent electrode 425 has the same position and angle as the line connecting the two acute angle portions 10*a* of the compression chamber 10. The line connecting the two obtuse angle portions 425*ab* of the independent main electrode 425*a* has the same position and angle as the line connecting the two obtuse angle portions 10*b* of the compression chamber 10. As a result, the amount of displacement of the displacing element may be increased. The position of these lines may vary up to 10% of the maximum width of the compression chamber, and the angles may vary by up to 10 degrees. The amount of displacement may be increased by configuring the area of the independent main electrode 425*a* to between 50 to 90% of the area of the compression chamber 10, and preferably to between 60 to 80%.

The lead-out electrode 425*b* is connected to the independent main electrode 425*a* at one acute angle portion 425*a*. The connected portion is positioned to the acute angle portion 10*a* of the compression chamber 10. The lead-out electrode 425*b* bends at an angle between 90 to 180 degrees so as to fold back at the exterior side of the acute angle portion 10*a* (region not overlapping with the compression chamber 10), and the portion from this until the end which forms a connecting electrode 426 is equal to a straight line 425*ba*. As a result, the position of the end of the lead-out electrode 425*b* in the direction of the column is closer to the independent main electrode 425*a* that is led out than the acute angle portion 10*a* of the compression chamber 10 from which the lead-out electrode 425*b* is led out. As a result, distance can be kept from the other compression chambers 10 lined in the direction of the column, which may reduce crosstalk.

The angle of straight line 425*ba* will be described next. The angle formed between the straight line 425*ba* (the imaginary line LC extends at the same angle as the straight line 425*ba*) and the imaginary line LA3 extending in the direction of the row is labeled as C. The imaginary lines extending the two edges of the diamond shape sandwiching the acute angle portions 425*aa* of the independent main electrode 425*a* connected to the lead-out electrode 425*b* are labeled as LD1 and LD2. The angles formed from the LD1 and LD2 with the imaginary line LA3 extending in the direction of the row are labeled as D1 and D2. The angles C, D1, and D2 are acute angle portions and therefore no more than 90 degrees.

The value of adding the angle D1 and the angle D2 is at least 90 degrees as the acute angle portions 425*aa* is an acute angle. The angle D1 may be different from the angle D2. That is to say, the angle of the line connecting the obtuse angle portions 425*ab* and the line connecting the acute angle portions 425*aa* regarding the diamond shape of the independent main electrode 425*a* may vary from the angle of the direction of the row and the direction of the column regarding the compression chamber 10. By configuring the variance of the angles to no more than 20 degrees, crosstalk may be reduced as the edges do not face the units of the compression chamber 10 adjacent in the direction of the column.

By configuring the angles D1 and D2 to between 55 and 75 degrees, the amount of displacement may be increased while decreasing the dimension in the direction of the row, which enables high precision in arrangements in the direction of the row for improving printing resolution. By configuring the angle C to be smaller than the angle D1 and D2, precision in forming the straight line 425*ba* may be improved, which helps prevent the occurrence of variances in forming positions due to variances in forms, variances in ejecting performance caused by variances in resistance values, and line breakage.

The independent electrode 425 is preferably formed by firing a screen-printed conductive paste as this is inexpensive and is produced in high yields. The screen printing is performed by attaching a mesh of metal wire knitted in a grid pattern to a rectangular frame, forming an opening in the resist attached to this mesh, and then using a squeegee to push the conductive paste through this opening. When performing this kind of printing, the thickness of the independent electrode 425 of the portion corresponding to the opening thickens in a grid pattern, and the form of the external perimeter of the independent electrode 425 has slight grid-pattern like variances.

The squeegee is normally set to move horizontally in relation to the screen frame to reduce variances in the width of the material being printed in the direction of movement of the screen, in screen printing. This is due to variances in the printing state caused by changes in the printing conditions when the position in relation to the screen is changed or changes in the length through the screen between the material to be printed and the squeegee when the squeegee moves during the screen printing process. When printing is repeated at an angle of zero degrees regarding the grid-pattern mesh corresponding to the screen frame, the effect of variances in the screen toward the direction of the printing due to the squeegee increases, and so this is slightly angled off.

The conductive paste is not supplied directly to the portion where the wire is present during the printing, and so is printed by the flow of the conductive paste from the perimeter. For this reason, variances in the form of the conductive pattern readily occur if the angle between the wire and the exterior circumference of the conductive pattern is small, and the corresponding position also becomes close, as the supply of the conductive paste only comes from the other side of the wire. The angle of the mesh should be adjusted to improve precision in printing the outer circumference of the independent main electrode 425*a* with particular regard to the demanded positional precision.

The angle of the mesh is preferably different from the angles of sides of the diamond shape of the independent main electrode 425*a* and the angles D1 and D2. That is to say, the angle of the wire intersecting the mesh should be larger than the angle (90−D1) and the angle (90−D2), but smaller than the angle D1 and D2, and preferably set to 45 degrees. The angle C of the straight line 425*ba* is preferably larger enough to reduce crosstalk by separating the straight line 425*ba* from the adjacent compression chamber 10. The precision in forming the straight line 425*ba* may be less than for that of the independent main electrode 425*a*, and so setting the angle C to at least (90−D1) or (90−D2) may decrease crosstalk. Conversely, an angle over 45 degrees has a negative effect on the forming precision, and so the angle is preferably no more than 45 degrees. More specifically, the range of the angle C is preferably at least five degrees larger than (90−D1) or (90−D2) and at least five degrees smaller than 45 degrees, and therefore 95−D1≤C, 95−D2≤C, and C≤40.

Two rows of the compression chamber row 11 are connected to the secondary manifold 5*a* with one row provisioned to the right and one row provisioned to the left of one secondary manifold 5*a* from the planar perspective in the head body 2*a*. The units of the compression chamber 10 belonging to the two rows of the compression chamber row 11 include a first region overlapping with the secondary manifold 5*a* and a second region not overlapping. Such an arrangement increases the width of the secondary manifold, which enables the flow amount to be secured as well as shortening the length of the head body 2*a* in the latitudinal direction.

However, configuring such an arrangement may produce variances in ejecting performance due to whether the lead-out electrode 25*b* is led out from the first region of the compression chamber 10 or the second region. The is because effect of the piezoelectric deformation of the piezoelectric ceramic layer 21*b* during the time when there is a difference in voltage between the lead-out electrode 25*b* and the shared electrode 24 is different regarding the lead-out electrode 25*b* led out from the first region in which the secondary manifold 5*a* is directly beneath and the lead-out electrode 25*b* led out from the second region in which the secondary manifold 5*a* is not directly beneath. For example, when the secondary manifold 5*a* is directly beneath, constructional deformation occurs readily, which causes the ejecting conditions from varying significantly from the ideal state due to the piezoelectric deformation directly below the lead-out electrode 25*b*. This may cause a decrease in the ejection speed or the ejection amount.

Figure 9:
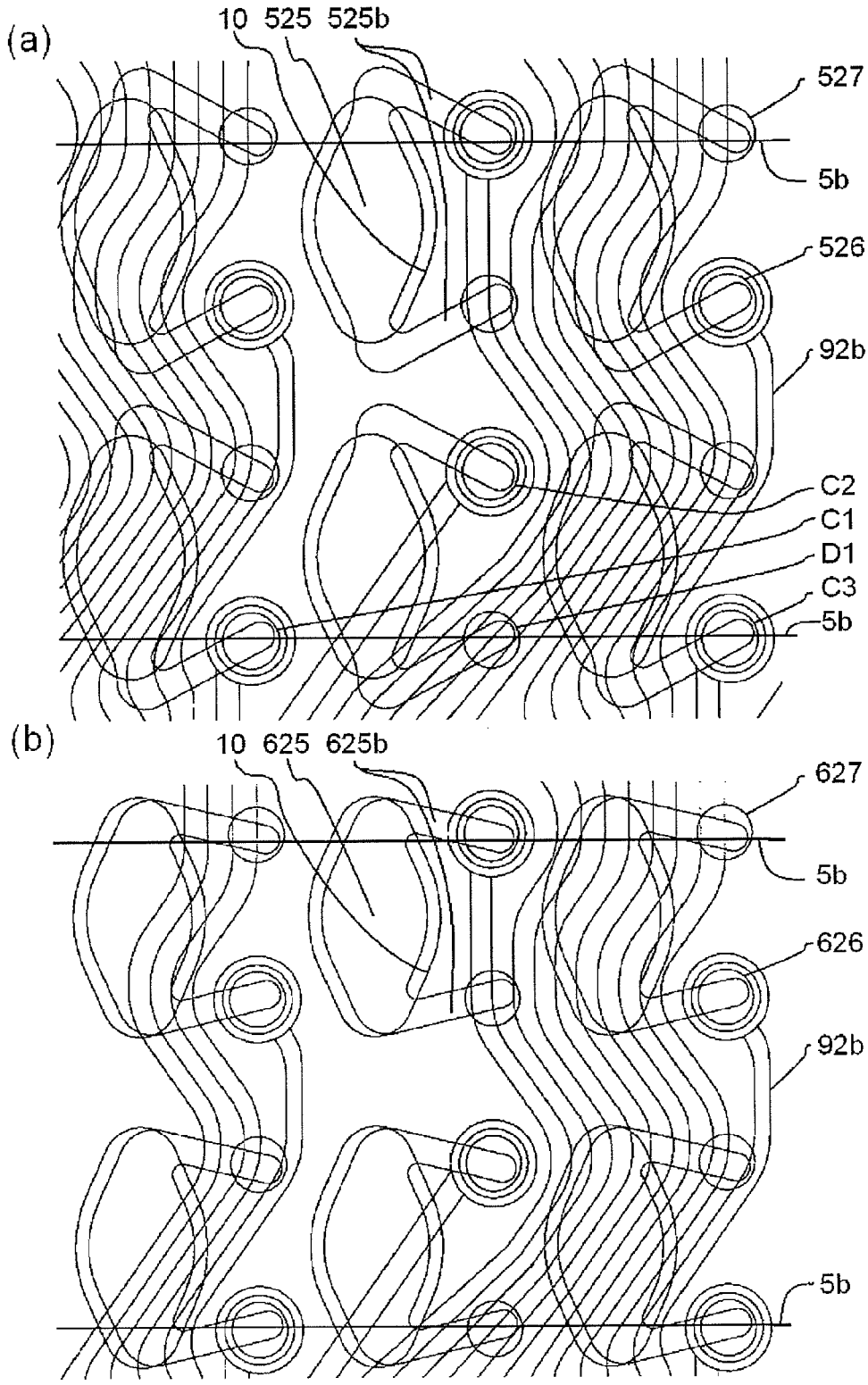
FIGS. 9(*a*) and (*b*) are enlarged plan views of the liquid ejecting head including a circuit board according to another embodiment of the present invention.

Therefore, a construction such as that illustrated in FIG. 9(*a*) is implemented. FIG. 9(*a*) is an enlarged plan view of the liquid ejecting head according to the other embodiment of the present invention. The basic configuration is the same as that of the liquid ejecting head illustrated in FIG. 2 through FIG. 5, and so an independent electrode 525 is the focus of the drawing as this is the difference in this construction. Also, FIG. 9(*a*) illustrates the wiring 92*b* of the signal transmission unit 92, which is the circuit board connected to the piezoelectric actuator 21. The lines in the drawing are all illustrated as solid lines even though some of these are actually transparent so as to not overcomplicate the drawing. Two units of a lead-out electrode 525*b* are provisioned to the independent electrode 525 in the liquid ejecting head 2 illustrated in FIG. 9(*a*). One lead-out electrode 525*b* is led out from the acute angle portion of the compression chamber 10 positioned to overlap the secondary manifold 5*a*, and the other is led out from the acute angle portion of the compression chamber 10 positioned to not overlap with the secondary manifold 5*a*, which reduces variances in ejects.

Multiple units of the lead-out electrode 525*b* may be led out from one acute angle portion. In this case, configuring the number of electrodes led out from the acute angle portion overlapping the secondary manifold 5*a* to be the same as that led out from the acute angle portion not overlapping the secondary manifold 5*a*, or configuring the total area of the these units of the lead-out electrode 525*b* to be the same helps prevent differences in the effect of the piezoelectric deformations and may reduce variances in ejects.

Multiple units of the wiring 92*b* are in an arrangement lined up in the direction of the row extending along the direction of the column. In this case, one lead-out electrode 525*b* from a group of two lead-out electrodes 525*b* is designated to be electrically connected to the wiring 92*b*. By alternating the lead-out electrode 525*b* to connect within the compression chamber row 11, the spacings of the wiring 92 may be increased, which enables the width of the wiring 92*b* to be increased and improves reliability.

Seven units of the wiring 92*b* are arranged between a connecting electrode 526 positioned at C1 and the connecting electrode 526 positioned at C3. Due to the previously described alternating connections, this arrangement has a relative amount of margin. However, when implementing a non-alternating arrangement, and the electrical connection occurs at the position of D1, which is the other lead-out electrode 525*b* instead of the position of C2, for example, six units of the wiring 92*b* will be provisioned between the position of D1 and the position of C2, meaning that the width of the wiring 92*b* is narrower, and the spacings of the wiring 92*b* also narrower. This design increases the cost of the wiring board 92, leads to poor reliability, and if the spacings are too narrow, the design may not function properly. The alternating arrangement is particularly desirable when the wiring 92*b* are arranged to a single-layer wiring board 92.

The connecting electrode 526 is provisioned to the lead-out electrode 525*b* electrically connected to the wiring 92*b* in FIG. 9(*a*), and a dummy connecting electrode 527 is connected to the lead-out electrode 525*b* not electrically connected to the wiring 92*b*. The connecting electrode 526 protrudes from the face of the piezoelectric actuator substrate 21, which results in a portion receiving force when the piezoelectric actuator substrate 21 and the fluid channel member 4 are joined. Provisioning the dummy connecting electrode 527 having the same form enables this force to be applied more evenly, and so this joining may be performed soundly. The dummy connecting electrode 527 may be provisioned to a position other than on the lead-out electrode 525*b*, but provisioning this on the lead-out electrode 525*b* suppresses the occurrence of differences in thickness between the connecting electrode 526 and the lead-out electrode 525*b*.

FIG. 9(*b*) is an enlarged plan view of the liquid ejecting head according to the other embodiment of the present invention similar to FIG. 9(*a*). An independent electrode 626 includes a lead-out electrode 625*b* led out from two acute angle portions respectively. One of the two lead-out electrodes 625*b* is electrically connected to the wiring 92*b* of the wiring board 92, and the other is not connected. The acute angle portion is the position between the two straight edges of the diamond-shaped compression chamber 10 where an angle is formed by these two edges, or the position where a curved line forms rounding the angle, and the angle formed by the two edges is an acute angle portion of no more than 90 degrees. The lead-out electrode 625*b* is led out from the acute angle portion by passing through this angle or the position of the curved line rounding this angle. Bending the lead-out electrode 625*b* just before the very end of the acute angle portion as in FIG. 9(*b*) reduces a reduction in displacement caused by the piezoelectric displacement of the piezoelectric ceramic layer 21*b* directly below the lead-out electrode 625*b*, which may reduce the effect of crosstalk.

The previously described liquid ejecting head 2 is manufactured in the following manner, for example. A tape made from piezoelectric ceramic powder and an organic composition is formed by a general tape forming process such as roll coating or slit coating to manufacture multiple green sheets which become the piezoelectric ceramic layer 21*a* and 21*b* after firing. An electrode paste, which becomes the shared electrode 24 on this surface, is formed on a portion of the green sheet by printing or similar. A via hole may be formed on a portion of the green sheet as necessary, and a via conductive is filled in this interior.

The green sheets are then laminated to manufacture a laminated body, cut into rectangular shapes after pressurization, and fired under atmospheric conditions with a high concentration of oxygen. An organometallic paste was printed onto the surface of the fired piezoelectric actuator element by screen printing, and then fired to form the independent electrode 25. The screen printing was performed using a screen to which a mesh is attached at a 45-degree angle in relation to a frame, placing the rectangular-shaped piezoelectric actuator element parallel with the screen frame, and moving a squeegee horizontally in the longitudinal direction of the piezoelectric actuator element. Afterwards, an Ag paste is used to print the connecting electrode 26, and the piezoelectric actuator substrate 21 is manufactured by firing.

Next, the fluid channel member 4 is manufactured by laminating the plates 4*a* through *l* obtained by the rolling method or similar with an adhesive. Holes which become the manifold 5, the independent supply channel 14, the compression chamber 10, and the descender are etched into the plates 4*a* through *l* with predetermined forms.

These plates 4*a* through *l* are preferably formed by at least one type of metal selected from a group of Fe—Cr metals, Fe—Ni metals, and Wc—TiC metals. Fe—Cr metals are particularly desirable when the liquid to be used is ink, as these metals have superior corrosion resistances against ink.

The piezoelectric actuator substrate 21 and the fluid channel member 4 may be laminated using an adhesive, for example. The adhesive used may be a well-known material, but at least one type of thermosetting resin adhesive selected from a group of epoxy resin with a thermosetting temperature of between 100 and 150° C., a phenol resin, and a polyphenylene ether resin should be used to prevent any effect on the piezoelectric actuator substrate 21 and fluid channel member 4. By heating this kind of adhesive to the thermosetting temperature, the piezoelectric actuator substrate 21 and the fluid channel member 4 may be joined by heat.

Next, a silver paste is supplied to the connecting electrode 26 to electrically connect the piezoelectric actuator substrate 21 to the control unit 100, an FPC, which functions as the signal transmission unit 92 to which a driver IC has been previously implemented, is installed, and then heat is applied to the silver paste to harden and create the electrical connection. The implementation of the driver IC involves electrically connecting a flip chip to the FPC using solder, and then supplying and hardening a protective resin around the solder.

Next, a reservoir is attached as necessary to supply liquid from the opening 5*a*, and after screwing on a metal housing, the joined portions are sealed with a sealant, and thus the liquid ejecting head 2 may be manufactured.

REFERENCE SIGNS LIST

1 printer
2 liquid ejecting head
2*a* head body
4 fluid channel member
4*a* through *l* plates (of the fluid channel member)
5 manifold (shared channel)
5*a* opening (of the manifold)
5*b* secondary manifold
6 diaphragm
8 ejection hole
9 ejection opening row
10 compression chamber
10*a* acute angle portion
10*b* obtuse angle portion
11 compression chamber row
12 independent channel
14 independent supply channel
15 partition
21 piezoelectric actuator substrate
21*a* piezoelectric ceramic layer (vibration substrate)
21*b* piezoelectric ceramic layer
24 shared electrode (first electrode)
25, 225, 325, 425 independent electrode (second electrode)
25*a*, 425*a* independent main electrode
425*aa* acute angle portion (of the independent main electrode)
425*ab* obtuse angle portion (of the independent main electrode)
25*b*, 225*b*, 325*b*, 425*b* lead-out electrode
425*ba* straight line
26, 226, 326, 426, 526, 626 connecting electrode
527, 627 dummy connecting electrode
28 shared-electrode surface electrode
30 displacing element (pressurizing unit)
92 signal transmission unit (wiring board)
92*b* wiring

What is claimed is:

1. A fluid ejecting head comprising:

a plate member comprising:

a fluid channel therein; and an ejection hole at a surface thereof, connected to the fluid channel;

a piezoelectric plate on the plate member;

a chamber between the plate member and the piezoelectric plate, having a first diamond shape in a plan view with rounded corners comprising two obtuse angle corners and two acute angle corners;

a main portion on the piezoelectric plate and directly above the chamber, having a second diamond shape in a plan view similar to and smaller than the first diamond shape, wherein the first and second diamond shapes are overlapped and centered in the plan view;

an extraction electrode comprising:

a first end connected to the main portion at one of the acute corners; and a second end opposite to the first end, the second end disposed outside the chamber and not overlapping a line extending diagonal of the two acute angle corners; and a connection electrode adjacent to the main portion, not overlapping an imaginary line extending a diagonal of the two acute angle corners, and connected to the second end.

2. The fluid ejecting head according to claim 1, further comprising:

a driving electrode on the piezoelectric plate opposing to the main portion for driving the piezoelectric plate by applying a voltage between the main portion and the driving electrode.

3. The fluid ejecting head according to claim 1, wherein the piezoelectric plate comprises:

a support layer contacting with the plate member and comprising a non-piezoelectric material; and a piezoelectric layer comprising a piezoelectric material.

4. The A fluid ejecting head, comprising:

a plate member comprising:

a fluid channel therein; and an ejection hole at a surface thereof, connected to the fluid channel;

a piezoelectric plate on the plate member;

a chamber between the plate member and the piezoelectric plate, having a first diamond shape in a plan view with rounded corners comprising two obtuse angle corners and two acute angle corners;

a main portion on the piezoelectric plate and directly above the chamber, having a second diamond shape in a plan view similar to and smaller than the first diamond shape, wherein the first and second diamond shapes are overlapped and centered in the plan view; and an extraction electrode comprising:

a first end connected to the main portion at one of the acute corners;

a second end opposite to the first end, the second end disposed outside the chamber and not overlapping a line extending diagonal of the two acute angle corners;

a first portion overlapping an imaginary line extending diagonal of the two acute angle corners, including the first end; and a straight portion connected to the first portion, extending a linear fashion in a direction which forms an angle of 45 degree or less with an imaginary line extending an diagonal of the two obtuse angle corners, and including the second end.

5. The fluid ejecting head according to claim 4, further comprising:

a driving electrode on the piezoelectric plate opposing to the main portion for driving the piezoelectric plate by applying a voltage between the main portion and the driving electrode.

6. The fluid ejecting head according to claim 4, wherein the piezoelectric plate comprises:

a support layer contacting with the plate member and comprising a non-piezoelectric material; and a piezoelectric layer comprising a piezoelectric material.

7. A recording device comprising:

a fluid ejecting head according to claim 1 a conveying unit for conveying a recording medium toward the liquid ejecting head; and a control unit for controlling a piezoelectric actuator substrate.

8. A recording device comprising:

a fluid ejecting head according to claim 4 a conveying unit for conveying a recording medium toward the liquid ejecting head; and a control unit for controlling a piezoelectric actuator substrate.

* * * * *